US008731208B2

(12) United States Patent
Han

(10) Patent No.: US 8,731,208 B2
(45) **Date of Patent: *May 20, 2014**

(54) PORTABLE ELECTRONIC DEVICE HAVING UNIVERSAL EARPHONE JACK

(75) Inventor: Jia-Qing Han, Shenzhen (CN)

(73) Assignees: Shenzhen Futaihong Precision Industry Co., Ltd., Shenzhen (CN); Chi Mei Communications Systems, Inc., New Taipei (TW)

( * ) Notice: Subject to any disclaimer, the term of this patent is extended or adjusted under 35 U.S.C. 154(b) by 124 days.

This patent is subject to a terminal disclaimer.

(21) Appl. No.: 13/149,809

(22) Filed: May 31, 2011

(65) Prior Publication Data

US 2012/0170776 A1 Jul. 5, 2012

(30) Foreign Application Priority Data

Dec. 30, 2010 (CN) ..... 2010 1 0614562

(51) Int. Cl.
*H04R 1/10* (2006.01)

(52) U.S. Cl.
USPC ..... 381/74; 381/150; 381/123; 381/309; 381/384

(58) Field of Classification Search
None
See application file for complete search history.

(56) References Cited

U.S. PATENT DOCUMENTS 6,856,046 B1 * 2/2005 Scarlett et al. ..... 307/125
7,912,501 B2 * 3/2011 Johnson et al. ..... 455/556.1

* cited by examiner

*Primary Examiner* — Duc Nguyen
*Assistant Examiner* — Taunya McCarty
(74) *Attorney, Agent, or Firm* — Novak Druce Connolly Bove + Quigg LLP

(57) ABSTRACT

A portable electronic device includes an earphone jack for receiving an earphone plug, a switch unit and a signal processing unit. The switch unit is connected to the earphone jack and is switchable between a first state and a second state. The signal processing unit is connected to the earphone jack and the switch unit. The signal processing unit is used to identify a type of the earphone plug received in the earphone plug and control the switch unit to switch to either the first state or the second state according to the type of the earphone plug.

7 Claims, 5 Drawing Sheets

PORTABLE ELECTRONIC DEVICE HAVING UNIVERSAL EARPHONE JACK

BACKGROUND

1. Technical Field

The disclosure generally relates to portable electronic devices, and particularly to a portable electronic device having an earphone jack, which can receive multiple types of earphone plugs.

2. Description of Related Art

An earphone plug usually includes a first contact portion, a second contact portion, a third contact portion, and a fourth contact portion orderly formed thereon. Referring to a first type of earphone plug shown in FIG. 4, the first contact portion is a left channel point REC_L. The second contact portion is a right channel point REC_R. The third contact portion is a microphone channel point MIC. The fourth contact portion is a ground point GND. Referring to a second type of earphone plug shown in FIG. 5, the first contact portion is a left channel point REC_L. The second contact portion is a right channel point REC_R. The third contact portion is a ground point GND. The fourth contact portion is a microphone channel point MIC. A related portable electronic device usually can use only one of the first or the second type of earphone plug, and lacks flexibility.

Therefore, there is room for improvement within the art.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment.

DETAILED DESCRIPTION

Figure 1:
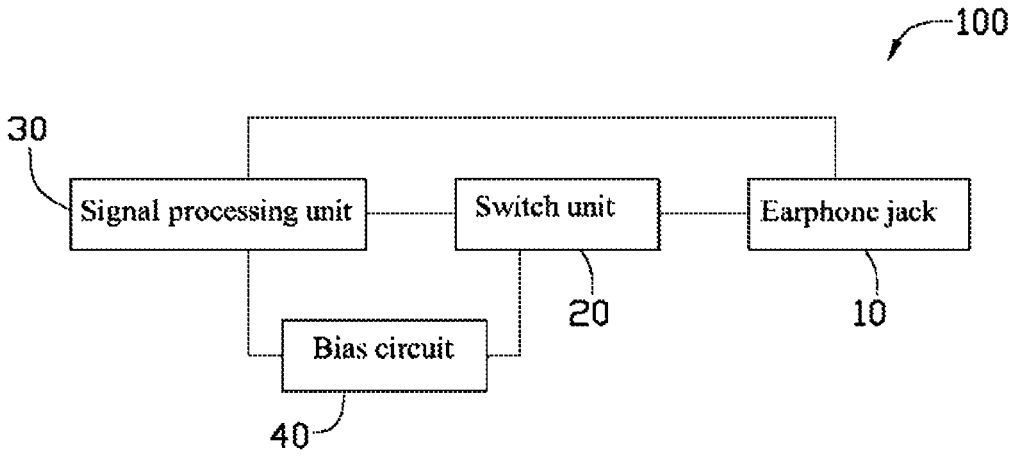
FIG. 1 is a block diagram of a portable electronic device, according to an exemplary embodiment.

FIG. 1 is a block diagram of a portable electronic device 100, according to an exemplary embodiment. The portable electronic device 100 includes an earphone jack 10, a switch unit 20, a signal processing unit 30, and a bias circuit 40. The switch unit 20 is connected to the earphone jack 10. The signal processing unit 30 is connected to the earphone jack 10 and the switch unit 20. The bias circuit 40 is connected to the switch unit 20 and the signal processing unit 30.

Figure 2:
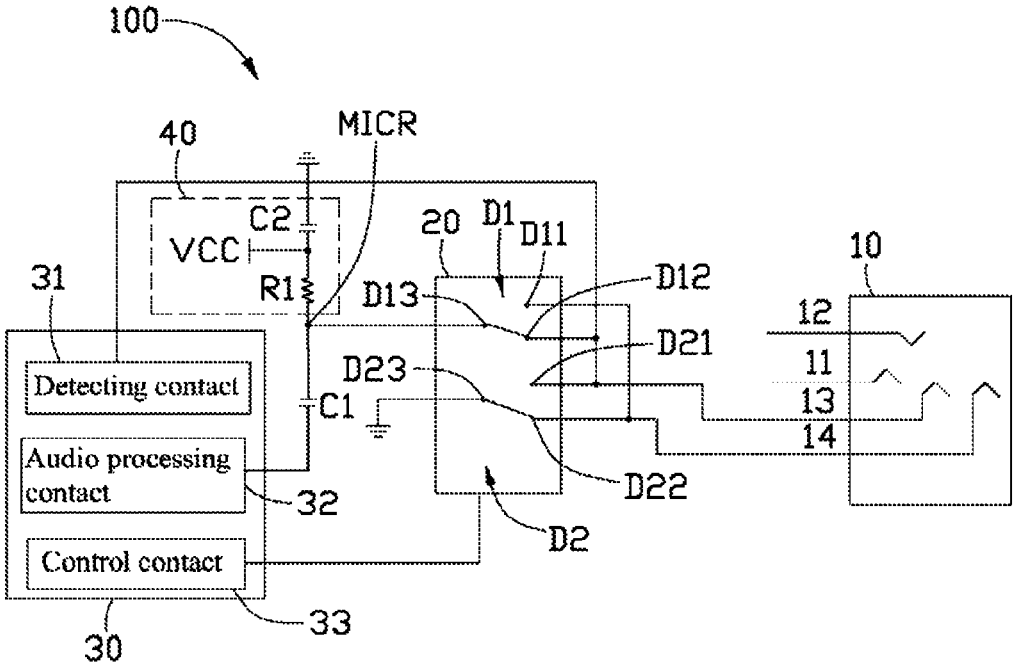
FIG. 2 is a circuit diagram of the portable electronic device of FIG. 1 receiving a first type of earphone plug.
Figure 4:
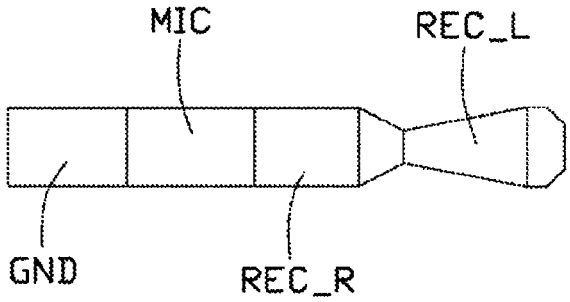
FIG. 4 (RELATED ART)
FIG. 4 is a schematic view of the first type of earphone plug of FIG. 2.
Figure 5:
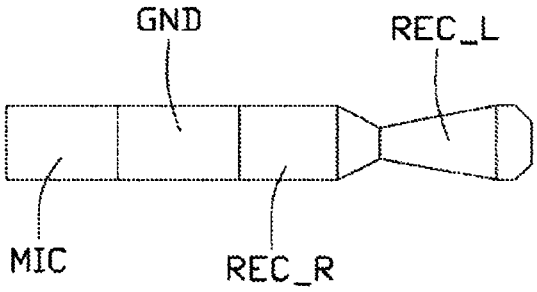
FIG. 5 (RELATED ART)
FIG. 5 is a schematic view of the second type of earphone plug of FIG. 3.

Also referring to FIG. 2, the earphone jack 10 includes a first contact 11, a second contact 12, a third contact 13, and a fourth contact 14. When an earphone plug such as one of the earphone plugs shown in FIG. 4 or FIG. 5 is received in the earphone jack 10, the first, second, third and fourth contacts 11-14 are respectively connected to the first, second, third and fourth contact portions of the earphone plug. The earphone can receive audio from, and send audio if microphone equipped, to the portable electronic device 100.

Figure 3:
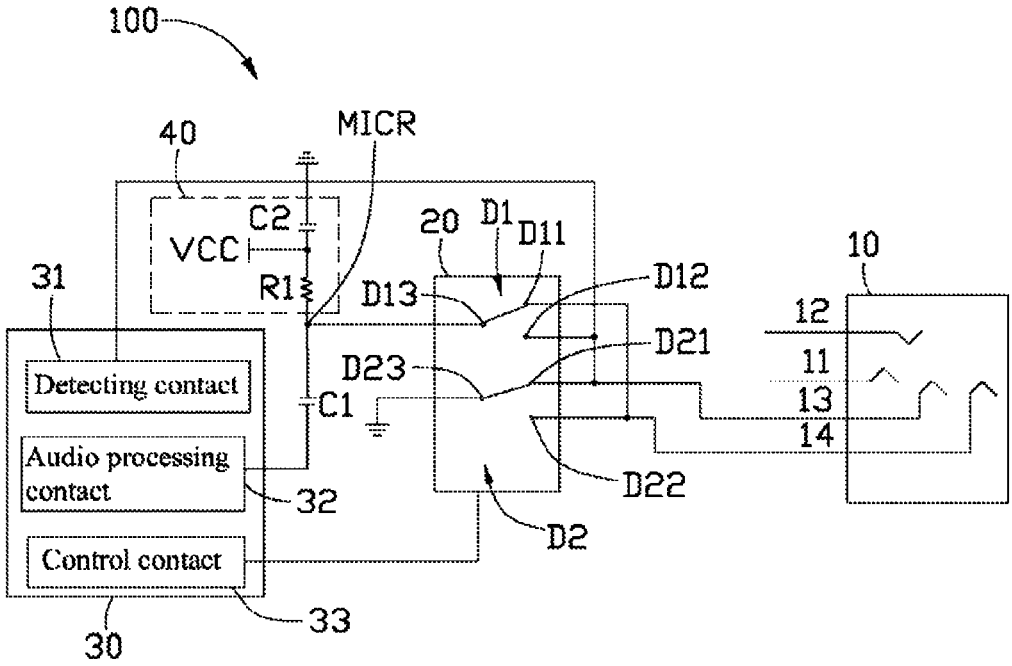
FIG. 3 is a circuit diagram of the portable electronic device of FIG. 1 receiving a second type of earphone plug.

Also referring to FIG. 3, the switch unit 20 includes a first switch D1 and a second switch D2. The first switch D1 and the second switch D2 are both single pole double throw switches. The first switch D1 includes a first fixed contact D11, a second fixed contact D12, and a first movable contact D13. The second switch D2 includes a third fixed contact D21, a fourth fixed contact D22, and a second movable contact D23. The switch unit 20 includes a first state and a second state. In the first state, the first movable contact D13 and the second movable contact D23 are respectively connected to the second fixed contact D12 and the fourth fixed contact D22. In the second state, the first movable contact D13 and the second movable contact D23 are respectively connected to the first fixed contact D11 and the third fixed contact D21.

The first fixed contact D11 and the fourth fixed contact D22 are connected to the fourth contact portion of the earphone plug by the fourth contact 14. The second fixed contact D12 and the third fixed contact D21 are connected to the third contact portion of the earphone plug by the third contact 13. The first movable contact D13 serves as an audio contact MICR for receiving audio from or sending audio to the earphone plug received in the earphone jack 10 by the switch unit 20. The second movable contact D23 is grounded.

The signal processing unit 30 includes a detecting contact 31, an audio processing contact 32, and a control contact 33.

The detecting contact 31 is connected to the third contact 13. When either of the earphone plugs shown in FIG. 4 or FIG. 5 is received in the earphone jack 10, the detecting contact 31 detects voltage of the third contact portion of the earphone plug through the third contact 13. The voltages of the third contact portions of the first type of earphone plug (i.e. the microphone channel point MIC) and the second type of earphone plug (i.e. the ground point GND) fall into different voltage ranges. Therefore, the detecting contact 31 can identify the type of the earphone plug received in the earphone jack 10 according to the detected voltage.

An end of the audio processing contact 32 is connected to the audio receiving contact MICR by a first capacitor C1. Another end of the audio processing contact 32 is connected to an audio processing circuit (not shown) set in the portable electronic device 100. The audio processing circuit is used to receive and process audio from the third contact portion of the first type of earphone plug or the fourth contact portion of the second type of earphone plug.

The control contact 33 is connected to the switch unit 20. The control contact 33 switches the switch unit 20 to a corresponding mode (i.e. the first state or the second state) according to the type of the earphone plug received in the earphone jack 10.

The bias circuit 40 is used to supply a bias voltage for audio signals from the earphone plug received in the earphone jack 10. The bias circuit 40 includes a resistor R1. The resistor R1 is set between the audio receiving contact MICR and a power VCC. The bias circuit 40 further includes a second capacitor C2. One end of the second capacitor C2 is connected to a node of the power VCC and the resistor R1. Another end of the second capacitor C2 is grounded.

When the detecting contact 31 detects that the first type of earphone plug is received in the earphone jack 10, the control contact 33 controls the switch unit 20 to switch to the first state. That is, the first movable contact D13 and the second movable contact D23 are respectively connected to the second fixed contact D12 and the fourth fixed contact D22. So the third contact portion of the first type of earphone plug is connected to the audio contact MICR through the third contact 13 and the switch unit 20. The fourth contact portion of the first type of earphone plug is grounded through the fourth contact 14 and the switch unit 20. The first type of earphone plug can be used by the portable electronic device 100.

When the detecting contact 31 detects that the second type of earphone plug is received in the earphone jack 10, the control contact 33 controls the switch unit 20 to switches to the second state. That is, the first movable contact D13 and the second movable contact D23 are respectively connected to the first fixed contact D11 and the third fixed contact D21. So the third contact portion of the second type earphone is grounded by the third contact 13 and the switch unit 20. The fourth contact portion of the second type earphone is connected to the audio receiving contact MICR by the fourth contact 14 and the switch unit 20. The second type of earphone plug can be used by the portable electronic device 100.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A portable electronic device, comprising:

an earphone jack configured to receive an earphone plug, the earphone jack including a first contact, a second contact, a third contact and a fourth contact;

a switch unit connected to the earphone jack, the switch unit configured to switch between a first state and a second state; the switch unit including a first switch, the first switch configured to switch between the third contact and the fourth contact;

a signal processing unit connected to the earphone jack and the switch unit, the signal processing unit including an audio processing contact connected to the first switch, wherein the signal processing unit identifies a type of the earphone plug received in the earphone plug and controls the switch unit to switch to either the first state or the second state according to the type of the earphone plug, the audio processing contact is connected to the third contact in the first state or is connected to the fourth contact in the second state for receiving and processing audio from the earphone plug by the earphone jack;

wherein the switch unit further includes a second switch, the first switch includes a first fixed contact, a second fixed contact, and a first movable contact; the second switch includes a third fixed contact, a fourth fixed contact, and a second movable contact; in the first state, the first movable contact and the second movable contact are respectively connected to the second fixed contact and the fourth fixed contact; in the second state, the first movable contact and the second movable contact are respectively connected to the first fixed contact and the third fixed contact;

the second fixed contact and the third fixed contact are connected to the third contact; the first fixed contact and the fourth fixed contact are connected to the fourth contact; the first movable contact serves as an audio contact for receiving audio from or sending audio to the earphone plug received in the earphone jack; the second movable contact is grounded.

2. The portable electronic device as claimed in claim 1, wherein the signal processing unit includes a detecting contact connected to the third contact, the detecting contact used to identify the type of the earphone plug according to voltage of the third contact.

3. The portable electronic device as claimed in claim 1, wherein one end of the audio processing contact is connected to the audio contact by a first capacitor, another end of the audio processing contact is connected to an audio processing circuit set in the portable electronic device for receiving and processing audio from the earphone plug by the switch unit and the earphone jack.

4. The portable electronic device as claimed in claim 1, wherein the signal processing unit includes a control contact connected to the switch unit for controlling the switch unit to switch to either the first state or the second state according to the type of the earphone plug.

5. The portable electronic device as claimed in claim 1, further including a bias circuit connected to the signal processing unit and the switch unit, the bias circuit used to supply a bias voltage for audio signals from the earphone plug received in the earphone jack.

6. The portable electronic device as claimed in claim 5, wherein the bias circuit includes a resistor set between the audio receiving contact and a power.

7. The portable electronic device as claimed in claim 6, wherein the bias circuit further includes a second capacitor, one end of the second capacitor is connected to a node of the power and the resistor, another end of the second capacitor is grounded.

* * * * *